US008210444B2

(12) United States Patent
Osler

(10) Patent No.: US 8,210,444 B2
(45) Date of Patent: Jul. 3, 2012

(54) DIRECT FIXATION TRACK-MOUNTING ASSEMBLY

(76) Inventor: Wilbur F. Osler, Mattituck, NY (US)

( * ) Notice: Subject to any disclaimer, the term of this patent is extended or adjusted under 35 U.S.C. 154(b) by 0 days.

(21) Appl. No.: 12/906,663

(22) Filed: Oct. 18, 2010

(65) Prior Publication Data

US 2012/0091216 A1 Apr. 19, 2012

(51) Int. Cl.
*E01B 9/38* (2006.01)

(52) U.S. Cl. ..... 238/283; 238/264

(58) Field of Classification Search ..... 238/283, 238/264, 280, 306, 307, 287, 382
See application file for complete search history.

(56) References Cited

U.S. PATENT DOCUMENTS

| | | | | | |
|---|---|---|---|---|---|
| 4,715,533 | A * | 12/1987 | Bucksbee et al. | ..... | 238/283 |
| 4,757,945 | A * | 7/1988 | Leeves | ..... | 238/107 |
| 4,971,247 | A * | 11/1990 | Harkus | ..... | 238/283 |
| 5,346,131 | A * | 9/1994 | Meier et al. | ..... | 238/283 |
| 5,361,986 | A * | 11/1994 | Meier et al. | ..... | 238/283 |
| 5,494,212 | A * | 2/1996 | Owen | ..... | 238/265 |
| 6,761,322 | B1 * | 7/2004 | Porrill et al. | ..... | 238/264 |
| 6,789,740 | B2 * | 9/2004 | Osler | ..... | 238/264 |
| 6,880,764 | B2 * | 4/2005 | Schwarzbich | ..... | 238/287 |
| 6,986,470 | B2 * | 1/2006 | Osler | ..... | 238/264 |
| 7,533,829 | B2 * | 5/2009 | Osler et al. | ..... | 238/264 |
| 8,042,747 | B2 * | 10/2011 | Mospan et al. | ..... | 238/283 |
| 8,056,826 | B2 * | 11/2011 | Osler et al. | ..... | 238/264 |
| 2001/0023898 | A1 * | 9/2001 | Larke | ..... | 238/283 |
| 2006/0196962 | A1 * | 9/2006 | Osler et al. | ..... | 238/287 |
| 2007/0235551 | A1 * | 10/2007 | Ellerhorst | ..... | 238/283 |
| 2008/0093472 | A1 * | 4/2008 | Hohne et al. | ..... | 238/351 |
| 2008/0265050 | A1 * | 10/2008 | Osler | ..... | 238/315 |
| 2009/0184172 | A1 * | 7/2009 | Osler et al. | ..... | 238/283 |
| 2009/0261177 | A1 * | 10/2009 | Hamilton et al. | ..... | 238/283 |

* cited by examiner

*Primary Examiner* — S. Joseph Morano
*Assistant Examiner* — Jason C Smith
(74) *Attorney, Agent, or Firm* — Andrew Wilford

(57) ABSTRACT

A direction-fixation mount secures a track assembly to a flat upper surface of a fixed substrate. The track assembly includes a flat plate having a pair of opposite end edges, a track sitting on the plate, and fasteners securing the track to the plate. The direct-fixation mounting assembly has an elastomeric pad of predetermined stiffness underneath the plate and atop the surface so that the track and plate bears downward via the pad on the surface, and a pair of end restraints each having a rigid outer part fixed to the substrate offset outward from a respective one of the end edges of the plate, a rigid inner part spaced inward from the outer part and fixed to the respective outer end edge of the plate, and an elastomeric mass separate from the pad and fixed to and between the respective inner and outer parts.

10 Claims, 5 Drawing Sheets

FIG. 9
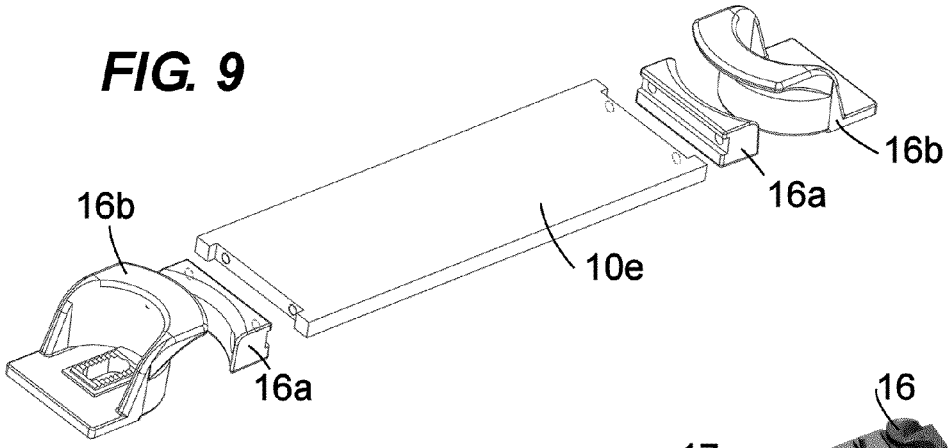
FIG. 10A
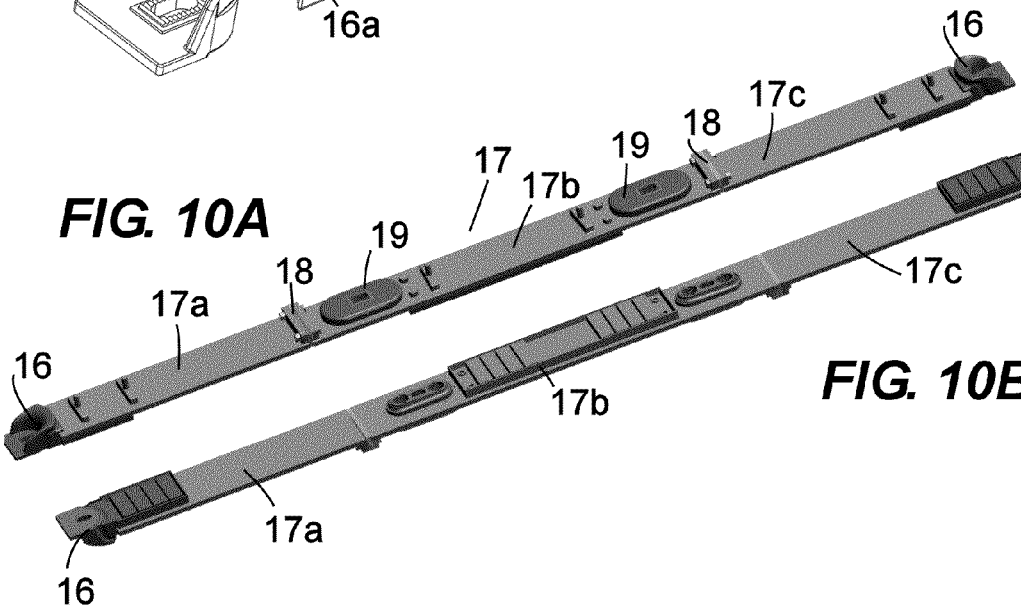
FIG. 10B
FIG. 10C
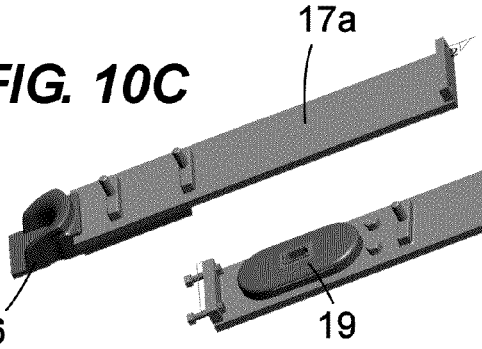
FIG. 10D
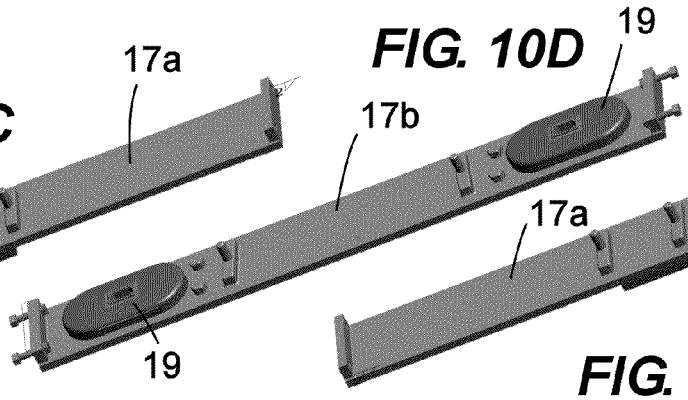
FIG. 10E
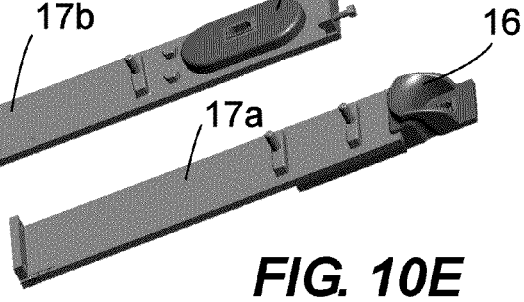

FIG. 11
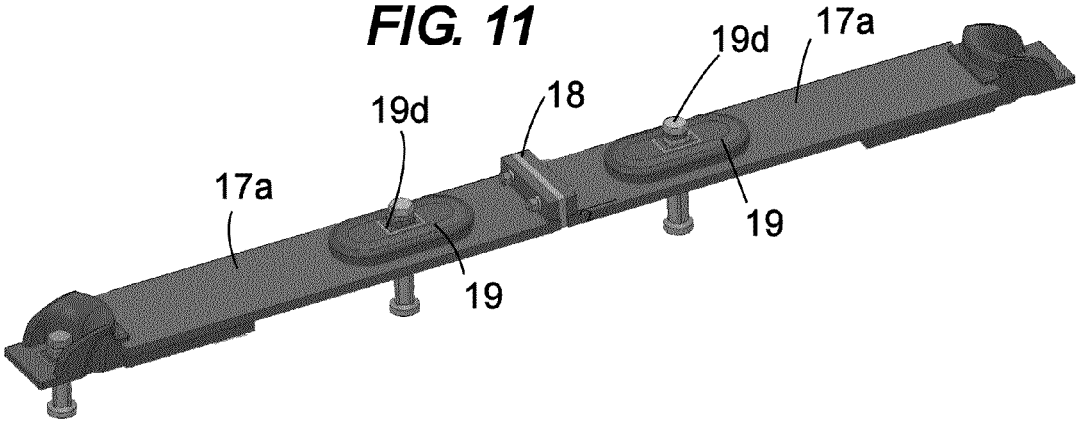
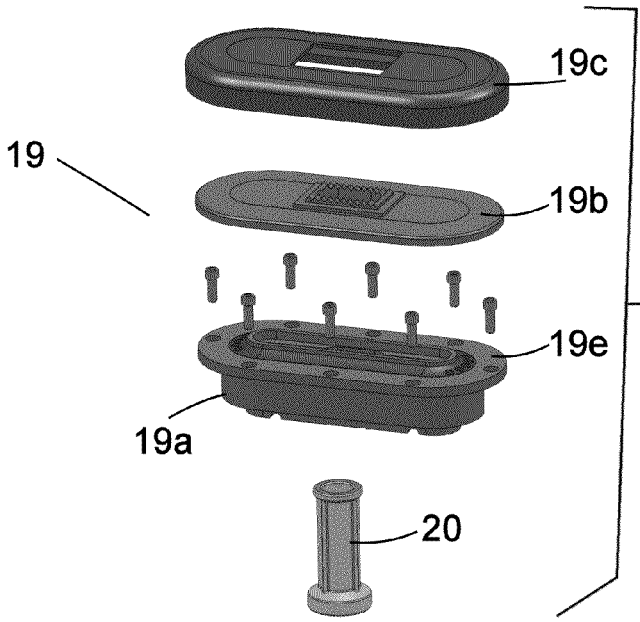
FIG. 12

DIRECT FIXATION TRACK-MOUNTING ASSEMBLY

CROSS REFERENCE TO RELATED APPLICATION

This application is related to copending patent application Ser. No. 12/411,473 filed 26 Mar. 2009.

FIELD OF THE INVENTION

The present invention relates to an assembly for mounting a track on a substrate. More particularly this invention concerns a resilient direct-fixation track mount of the type in which a metal top plate is received in a base frame that is attached to a sleeper or rail bed and a cushion sheet of elastomer bonded to both the top plate and the base frame is provided between the juxtaposed faces of the two parts.

BACKGROUND OF THE INVENTION

Successful rail mounting assemblies are disclosed in U.S. Pat. Nos. 6,789,740 and to 6,986,470. In these rail mounting assemblies that can be referred to as "egg" designs, the frame has a generally elongated or oval opening formed at its ends with inclined faces and four lugs symmetrically disposed at opposite ends of the frame to receive bolts for attachment of the base plate to the support structure.

The top plate is also symmetrical about the longitudinal axis and has at its ends inclined faces juxtaposed with the inclined faces of the frame and bonded, e.g. by vulcanization, to the elastomer sheet received between the juxtaposed faces and extending around the sides of the top plate and the frame. The bonding is at the inclined end faces only so that there is shear action here as well as compression to simultaneously cushion and limit relative movement of the top plate and base frame. Such track fasteners are particularly useful for vibration-sensitive locations.

In the known systems the elastomer sheet is largely unexposed and unsupported on the base frame except at the angled end faces. Even where some structure of the base frame may extend underneath the elastomer sheet other than at these angled end faces there is no bonding of the sheet to the base frame and/or top frame as the sole function of the sheet in this region is to undergo vertical compression.

Above-cited application Ser. No. 12/411,473 describes a rail-mounting assembly having a base frame formed unitarily formed with a pair of transversely spaced and longitudinally extending side members and a pair of longitudinally spaced and transversely extending end members generally bridging ends of the side members and having longitudinally inwardly directed generally vertical inner end faces. At least one web extending horizontally between the members has a substantially horizontal upper face and forms with the members at least one vertically throughgoing aperture. A top plate spaced above the base frame has a downwardly directed lower face having a portion spacedly vertically confronting the upper face of the web and a pair of respective longitudinally outwardly directed generally vertical outer end faces longitudinally spacedly horizontally confronting the inner end faces of the end members. An elastomeric body substantially fills between and is bonded to each of the outer end faces and the respective confronting inner end face. It also fills between and is bonded to the upper face of the web and the portion of the lower face confronting the upper face.

Such assemblies are fairly useful, but if the track is subjected to mixed axle traffic, dual stiffnesses would be very beneficial. If the traffic consists of transit vehicles (10-15 ton axles), high-speed passenger (20-24 ton axles) and freight (33 ton and up), instead of being locked into one stiffness that would be dictated by the heaviest axle, dual stiffness brings the choice of low stiffness (100,000 lbs/inch) for the lightest axles and high stiffness (300,000-400,000 lbs/inch) for the heaviest axles. Just such traffic is experienced in the AMTRAK North East Corridor in Trenton, namely SEPTA transit vehicles, AMTRAK Metro Liner and Conrail freight. To date such dual stiffness is unknown.

SUMMARY OF THE INVENTION

A direct-fixation mount secures a track assembly to a flat upper surface of a fixed substrate. The track assembly includes a flat plate having a pair of opposite end edges, a track sitting on the plate, and fasteners securing the track to the plate. The direct-fixation mounting assembly has according to the invention an elastomeric pad of predetermined stiffness underneath the plate and atop the surface so that the track and plate bears downward via the pad on the surface, and a pair of end restraints each having a rigid outer part fixed to the substrate offset outward from a respective one of the end edges of the plate, a rigid inner part spaced inward from the outer part and fixed to the respective outer end edge of the plate, and an elastomeric mass separate from the pad and fixed to and between the respective inner and outer parts.

Thus the end restraints, which determine the horizontal stiffness, are wholly separate from the pad that determines the vertical stiffness. Thus it is possible to set different horizontal and vertical stiffness in a single direct-fixation mount. The mount can be tailored to the requirements of the location.

The elastomer of the restraints is of different elasticity than the pad. The other restraints, regardless of their stiffness, are interchangeable, as are all the pads. The pads are only interchangeable if the plate sizes are the same and if the pads are not molded to the plate.

The pad includes an elastomeric sheet formed with an array of downwardly directed bumps engaging the surface of the substrate. The number, size, shape, orientation, and durometer of the bumps largely determines the vertical stiffness of the pad.

The pad further includes a thin metal sheet and an elastomeric layer on both faces of the thin metal sheet. The elastomeric layers extend past an outer periphery of and completely embed the sheet.

Each inner part of each end restraint is generally of C-section and has an inwardly open groove fitted over the respective edge of the plate. Furthermore according to the invention respective fasteners engage through the inner parts with the plate and fix the inner parts to the respective edges of the plate.

Each outer part is formed with an inner L-section leg engaged outward of and over the respective inner part. The elastomeric masses are each of L-section and engaged between the respective inner leg and an outer and upper face of the respective inner part. Furthermore each outer part has an outer leg engaged flatly on the surface of the substrate and formed with a vertically throughgoing hole. Respective screw fasteners engaged downward through the holes in the substrate. Each of the holes has a slot elongated generally perpendicular to the rail.

BRIEF DESCRIPTION OF THE DRAWING

The above and other objects, features, and advantages will become more readily apparent from the following description, reference being made to the accompanying drawing in which:

FIG. 9 is an exploded perspective view of the assembly according to the invention;

FIGS. 10A and 10B are top and bottom views of a gauge plate according to the invention;

FIGS. 10C-10E are top perspective views of the elements of the gauge plate of FIGS. 10A and 10B;

FIG. 11 is a perspective view of another gauge plate according to the invention; and FIG. 12 is an exploded view of the longitudinal restraint used with the assemblies of FIGS. 10A-E and 11.

SPECIFIC DESCRIPTION

Figure 1:
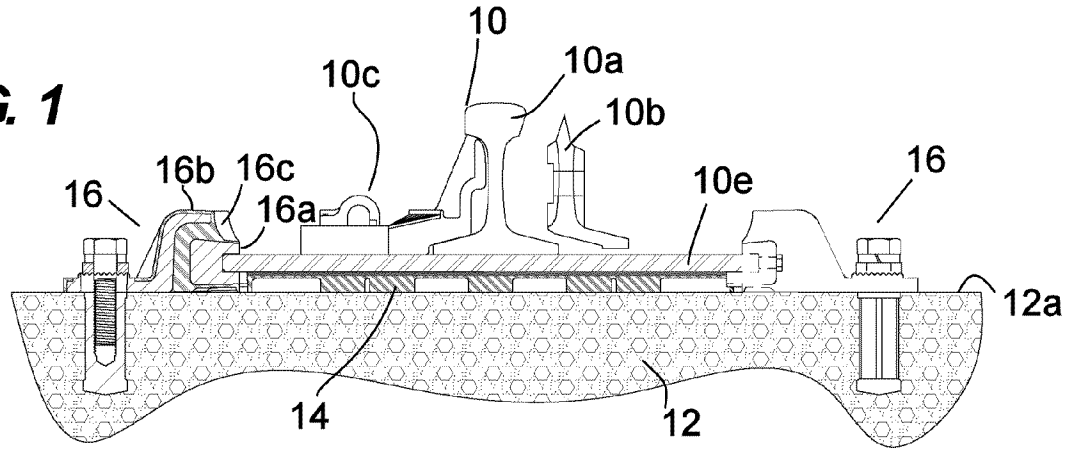
FIG. 1 is a partial vertical cross section through the assembly according to the invention.
Figure 2:
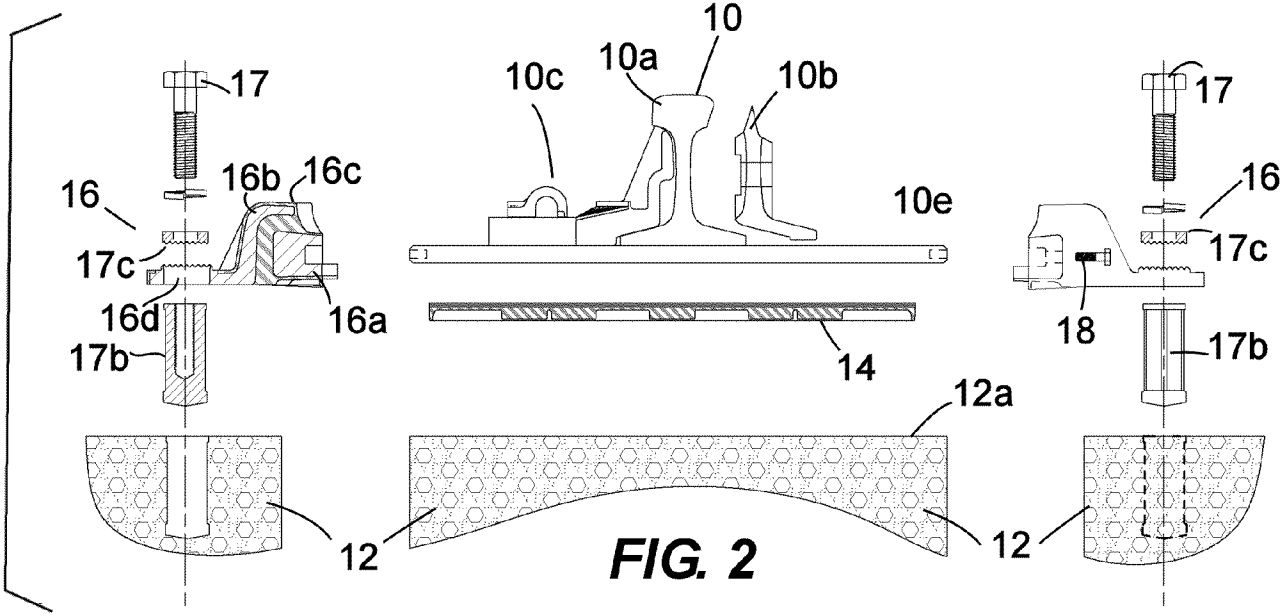
FIG. 2 is an exploded view of the structure shown in FIG. 1.

As seen in FIGS. 1 and 2, a basic track fixation assembly serves for securing a track assembly 10 composed of a running rail 10*a*, a switch rail 10*b*, attachment hardware 10*c*, and a ductile or nodular iron base plate 10*e* to a substrate 12, here a cast-concrete sleeper or slab with a planar upper face 12*a*. The assembly 10 is supplied by the trackwork manufacturer. The fixation assembly according to the invention basically comprises a pad 14 and a pair of end restraints 16.

Figure 3:
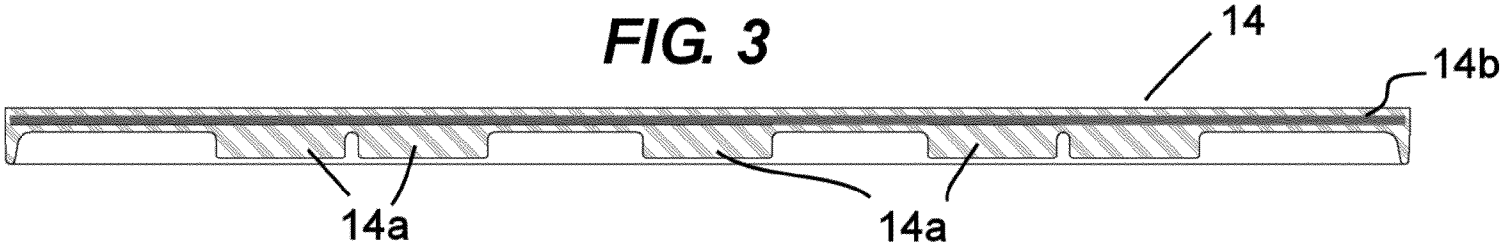
FIG. 3 is a top view of the base pad of the assembly.
Figure 4:
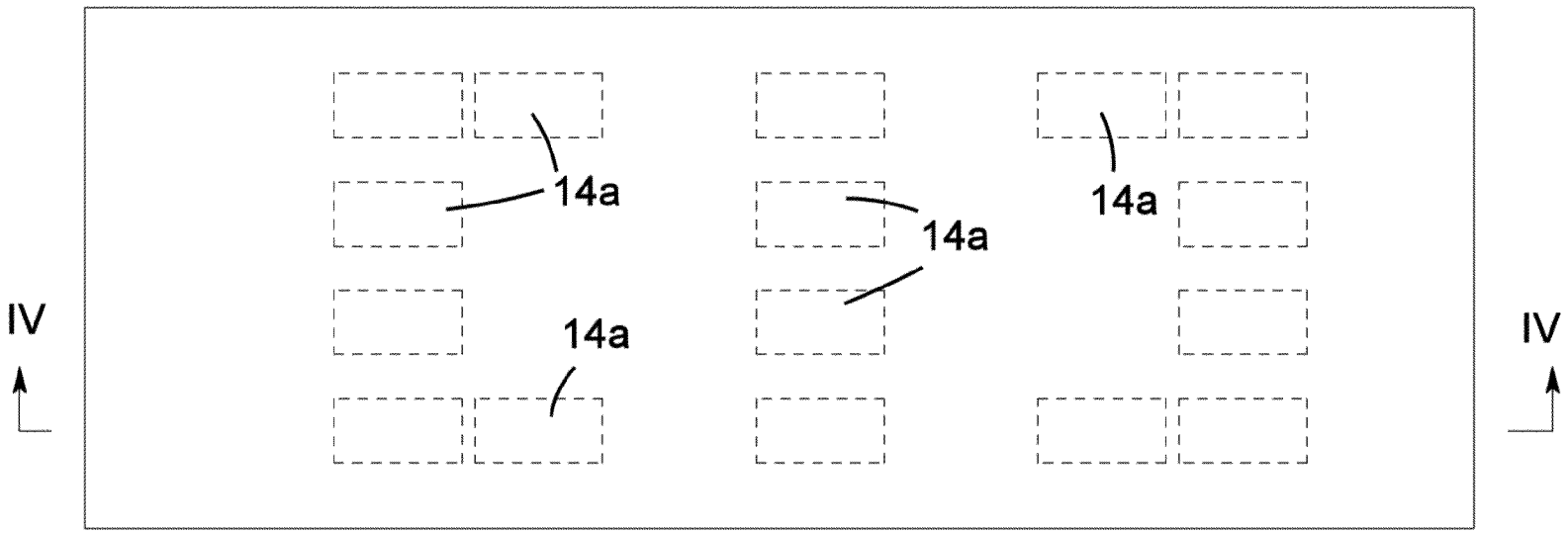
FIG. 4 is a cross section taken along line IV-IV of FIG. 3.
Figure 7:
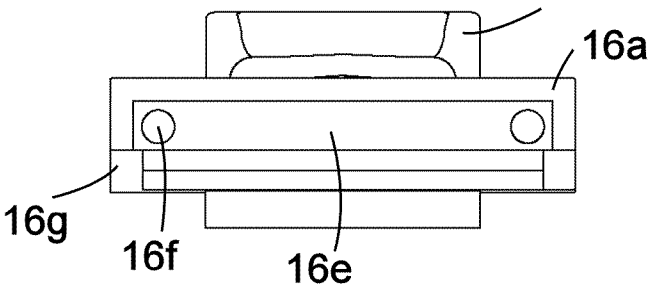
FIGS. 6, 7, and 8 are side views in the direction of respective arrows VI, VII, and VIII of FIG. 5.
Figure 8:
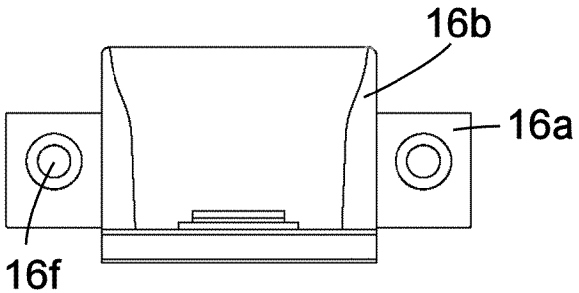
Figure 6:
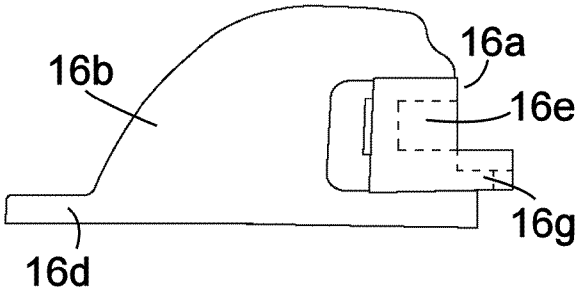
Figure 5:
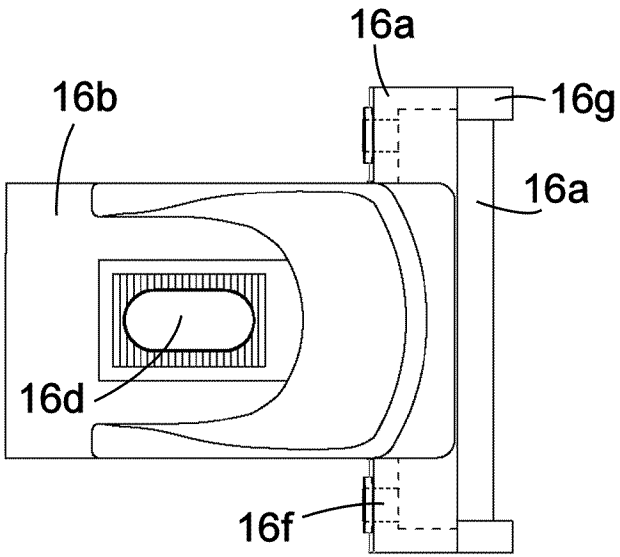
FIG. 5 is a large-scale top view of one of the end restraints of the assembly.

As shown in FIGS. 3 and 4 the pad 14 is basically rectangular, of generally the same size, configuration, and shape as the plate 10*e*, and formed of rubber laminated to both faces of a thin iron plate 14*b* that is slightly smaller than the pad 14 so that it is completely encased by it. The pad 14 has an array of downwardly projecting rectangular feet 14*a*. Between the number, size, and position of the feet 14*a* and the composition of the elastomer making up the pad 14, it is possible for the pad's stiffness to be varied widely. The plate 14*b* largely controls the elastomer of the pad 14 from being extruded to the side. The pad 14 is somewhat narrower than the plate 10*e* so as to lie wholly under it, although this pad 14 could also be bigger and project past the plate 10*e*.

As also shown in FIGS. 5-9 the two end restraints 16 each comprise a C-section iron inner part 16*a*, an outer part 16*b* (FIG. 1), and an L-section mass 16*c* of elastomer between and vulcanized to the confronting faces of the inner and outer parts 16*a* and 16*b* and to the inner portion of the upper face of the part 16*b*. The outer part 16*b* has an outer leg formed with a throughgoing slot 16*d* through which a bolt 21 (FIG. 2) set in an anchor 21*a* extends, with a spring washer 21*b* and a serrated washer 21*c* between a head of the bolt 21 and the ridged top face of the outer leg. The slot 16*d* extends perpendicular to the rail 10*a* so as to allow the restraint 16 some transverse adjustability. The inner part 16*a* is straight and elongated with a square-section groove or mouth 16*e* that fits snugly over the respective edge of the plate 10*e*. Two horizontally throughgoing holes 16*f* centered at ends of the mouth 16*e* accommodate screws 22 (FIG. 2) whose heads bear on the outer face of the part 16*a* and that are threaded into the plate 10*e* to lock the inner part 16*a* to the plate 10*e*, with small ears 16*g* at the ends the part 16*a* engaging under the plate 10*e* to maintain its relative position thereto.

Again, the restraints 16 can offer different levels of horizontal stiffness to the rail mount while all having the same external dimensions, depending on the composition and thickness of the mass 16*c*.

Thus it is possible for track to be installed with the horizontal and vertical resistance to movement set according to the exact needs of the location. It is a simple matter to use a different pad 14 and different end restraints 16.

FIGS. 10A and 10B show a three-part gauge plate 17 held between the end restraints 16. Such an assembly is used at a crossing, for instance with a running rail at each outer end and a frog in the center. The plate 17 comprises two identical end plates 17*a* and a center plate all bolted together at flanges 18. One of the pads 14 is provided under each of the parts 17*a* and 17*b* below the frog or respective track it supports.

FIG. 11 shows an arrangement where two of the plates 17*a* are secured directly together, that is without interposition of the part 17*b*, at their flanges 18. Such an assembly is used at a switch.

These parts 17*a* and 17*b* are here shown to be longitudinally stabilized by longitudinal restraints 19 shown in detail in FIG. 12. In FIGS. 10A-10E the longitudinal restraints are only provided in the center part 17*b* flanking the region where the frog is provided or center tracks merge or diverge, and in FIG. 11 they are provided on the end parts 17*a*.

Each such longitudinal restraint 19 comprises a horizontally elongated elastomeric block assembly 19*a* having semicircular ends and fitting in a complementary hole in the part 17*a* or 17*b*. The body 19*a* has an upper flange 19*e* that projects past the hole and lies atop the respective part 17*a* or 17*b*, and a metal plate 19*b* that is bigger than the hole and the same size as the flange 19*e* lies atop this flange 19 and in turn is covered by a rubber protector 19*c*. A bolt 19*d* projects down through the parts 19*a*, 19*b*, and 19*c* and is seated in an anchor 20 fixed in the substrate 12. Thus the restraints 19 effectively prevent any longitudinal shifting of the plates 17*a* and 17*b*.

I claim:

1. In combination with a fixed substrate having a flat upper surface and with a track assembly including a flat plate having a pair of opposite end edges, a track on the plate, and fasteners securing the track to the plate, a direct-fixation mounting assembly comprising:

an elastomeric pad of predetermined stiffness underneath the plate and atop the surface, whereby the track and plate bear downward via the pad on the surface; and a pair of end restraints each having a rigid outer part fixed to the substrate offset outward from a respective one of the end edges of the plate, a rigid inner part spaced inward from the outer part, generally of C-section, having an inwardly open groove fitted over the respective edge of the plate, and fixed to the respective outer end edge of the plate, and an elastomeric mass fixed to and between the respective inner and outer parts and of different elasticity than the pad.

2. The direct-fixation mounting assembly defined in claim 1 wherein the pad includes an elastomeric sheet formed with an array of downwardly directed bumps engaging the surface of the substrate.

3. The direct-fixation mounting assembly defined in claim 2 wherein the pad includes a thin metal sheet and an elastomeric layer on both faces of the thin metal sheet.

4. The direct-fixation mounting assembly defined in claim 3 wherein the elastomeric layers extend past an outer periphery of and completely embed the respective sheets.

5. The direct-fixation mounting assembly defined in claim 1, further comprising respective fasteners engaging through the inner parts with the plate and fixing the inner parts to the respective edges of the plate.

6. The direct-fixation mounting assembly defined in claim 1 wherein each outer part is formed with an inner L-section leg engaged outward of and over the respective inner part, the elastomeric masses each being of L-section and engaged between the respective inner leg and an outer and upper face of the respective inner part.

7. The direct-fixation mounting assembly defined in claim 1 wherein each outer part has an outer leg engaged flatly on the surface of the substrate and formed with a vertically throughgoing hole, the assembly further comprising respective screw fasteners engaged downward through the holes in the substrate.

8. The direct-fixation mounting assembly defined in claim 7 wherein each of the holes is a slot elongated generally perpendicular to the rail.

9. The direct-fixation mounting assembly defined in claim 1 wherein the plate is a gauge plate extending under a plurality of such tracks secured by respective such fasteners to the plate.

10. The direct-fixation mounting assembly defined in claim 9 wherein the gauge plate has offset from its ends a vertically throughgoing hole, further comprising:

a longitudinal restraint having a core part in the hole and having an outer periphery spaced inward from an inner periphery of the hole, an annular elastomeric body filling a spaced between the inner and outer peripheries, and a fastener securing the core part to the substrate.

* * * * *